United States Patent [19]

Andreae

[11] 3,975,842

[45] Aug. 24, 1976

[54] METHOD AND APPARATUS FOR DREDGING EMPLOYING A TRANSPORT FLUID FLOWING IN SUBSTANTIALLY CLOSED RECIRCULATING COURSE

[75] Inventor: Johannes Franciscus Reinardus Andreae, Gorinchem, Netherlands

[73] Assignee: Bos Kalis Westminster Group N.V., Sliedrecht, Netherlands

[22] Filed: Oct. 15, 1974

[21] Appl. No.: 514,506

[30] Foreign Application Priority Data

Oct. 15, 1973 Netherlands ..... 7314168

[52] U.S. Cl. ..... 37/58; 37/63; 37/195; 299/9; 302/15

[51] Int. Cl.[2] ..... E02F 3/88

[58] Field of Search ..... 37/58, 61–63, 37/195; 302/14–16; 299/8, 9

[56] References Cited

UNITED STATES PATENTS

| | | | |
|---|---|---|---|
| 196,645 | 10/1877 | Eads | 37/63 |
| 399,251 | 3/1889 | Edwards | 37/58 |
| 657,568 | 9/1900 | Robinson | 37/58 |
| 692,815 | 2/1902 | Bates | 37/63 |
| 724,501 | 4/1903 | Reno | 37/58 |
| 776,050 | 11/1904 | Frühling | 37/58 |
| 780,027 | 1/1905 | Edwards et al. | 37/63 |
| 861,745 | 7/1907 | Maxwell | 37/63 |
| 1,038,049 | 9/1912 | Van Wienen | 37/58 |
| 1,100,753 | 6/1914 | Long | 37/58 |
| 2,191,424 | 2/1940 | Cardinal | 37/61 UX |
| 2,252,803 | 8/1941 | Durepaire | 37/63 |
| 2,728,724 | 12/1955 | Gloor | 209/5 X |
| 2,961,782 | 11/1960 | Bos | 37/61 |
| 3,646,694 | 3/1972 | Beck, Jr. | 37/62 X |
| 3,783,535 | 1/1974 | Hanks | 37/63 X |

FOREIGN PATENTS OR APPLICATIONS

| | | | |
|---|---|---|---|
| 872,477 | 4/1953 | Germany | 37/62 |
| 873,734 | 7/1961 | United Kingdom | 37/58 |
| 1,056,632 | 1/1967 | United Kingdom | 37/63 |
| 124,372 | 3/1959 | U.S.S.R. | 37/58 |

*Primary Examiner*—Clifford D. Crowder
*Attorney, Agent, or Firm*—Watson Leavenworth Kelton & Taggart

[57] ABSTRACT

Dredging or suction of a soil suspension from the sea bottom is effected through a suction conduit connected with a suction head enclosure resting on the sea bottom, there concurrently being supplied to the suction head enclosure and through a separate conduit connected therewith a transport fluid under pressure. Transport fluid is separated from the soil suspension collected at the surface and recycled to the suction head enclosure. Thus the transport fluid flows in a substantially closed recirculating flow course and consequently pollution of the sea is lessened.

4 Claims, 7 Drawing Figures

METHOD AND APPARATUS FOR DREDGING EMPLOYING A TRANSPORT FLUID FLOWING IN SUBSTANTIALLY CLOSED RECIRCULATING COURSE

The invention relates to a method for the suction of a soil suspension in a transport medium such as water and sand, the suspension being supplied into a hopper, superfluous transport medium from the hopper being returned to adjacent the location where the soil suspension is sucked up. After completely filling the hopper a further supply of suspension may also take place for increasing the useful soil load, while superfluous transport water is discharged. The latter method is conventional when filling e.g. a suction dredger of the drag nozzle type, wherein the underwater drag nozzle is dragged over the bottom and the sucked suspension is discharged into the hopper. In the hopper are settled the soil particles being in suspension, while after completely filling the hopper an excess of water with a minimal concentration of solid particles is discharged via an overflow. The quantity of settled soil particles will gradually increase, while in the overflow the percentage of entrained solid particles will become increasingly higher.

The invention also concerns an apparatus for performing such a method comprising a hopper with discharge, a suction line with suction head connected to the hopper, a suction pump connected to said suction line for sucking and pumping a mud suspension towards the hopper, while furthermore there is provided a water supply line adjacent the suction head, which line may be connected to the discharge from the hopper. Such a water supply line is also used for loosening a soil mixture and/or controlling the concentration of the suspension to be sucked up.

It is a object of the present invention to provide an improved method and an apparatus of the above mentioned type.

Therefore it is proposed in such method to conduct the recycled transport medium directly towards the suction head in such a way that the transport medium is substantially completely in active recirculation. It is observed that it is understood by suspension not only a suspension in water of fine sand or clay particles but also mixtures of water with gravel, rutile sand, manganese nodules and other submarine minerals.

In this manner a substantially closed pressed system for the transport water can be realized so that pollution of the environment, both of the ambient water such as via an overflow from the hopper and of the suction head is avoided. Also the yield of the dredging process will be improved because soil particles still in suspension in the overflow water will be sucked up again at the suction head. By using the water supply line for loosening the soil, the effect of the water jets is increased by the presence of soil particles in the recycle water. Because no or only a slight quantity of water from the surroundings need be sucked up in the suction head, the yield of the suction dredger pump is improved. Since the dredging process is performed substantially exclusively with recycling water, ambient or outer water will practically no longer be used as transport medium. The hopper in this case will initially be filled completely or partly with fresh water, whereafter the described method can be employed for recovering sand and soil in salt water. In this manner a considerable degree of desalination is realized. It is also possible, mainly for sucking up very fine soil particles, to add a settling promoter to the circulating water.

It is observed that for sucking up mud very good results have been attained by starting from a partly waterfilled hopper, while recycling said water as transport medium. During the filling of the hopper the concentration of the mud in the transport medium will gradually increase. It has been found advantageous to stop the loading process as soon as the hopper is completely filled, which is unusual when sucking up sand, and not to discharge excess transport medium via an overflow.

In an apparatus of the above type according to the invention the suction head is adapted to function exclusively with the recycled water as transport medium. One or more separators may be built in the conduit system. Through application of a separator the overflow can be divided into two branch streams with respectively a higher and a lower concentration of soil particles. When the recycling system contains an excess of water, the branch stream having the minor concentration of soil particles can be fully or partly conducted outside the dredger, e.g., to the sea insofar environmental requirements do not oppose thereto. Preferably the branch stream having the higher concentration of soil particles is used for a water flushing installation connected to the water supply line. It will be clear that the supply line can be connected to the hopper at different places. Preferably, however, use is made of a vertically adjustable suction head, so that the water is discharged from the hopper at an optimal level. The concentration of soil particles will be lowest in said location.

By reconducting the recycled water to the suction head or to the drag nozzle in case of a suction dredger of the drag nozzle type, no ambient water will be supplied. As a result no entrance losses will occur. Also the pressure at the suction head will be higher, which has a favourable effect on the operation of the suction pump, the vacuum of which can be utilized more usefully for sucking up a more concentrated mixture. Also, as a result of the higher pressure — or lower vacuum — in the suction line less hindrance will be encountered of gases which may be released from the sucked up mixture. Because all the transport medium discharged from the hopper — having still a considerable concentration of soil particles, mainly in case of mud suction is reconducted to the suction head, there will be no loss of already loosened soil particles. A more than 100% larger useful load than hitherto was realized for specific mud types. Because in the recycling of the transport medium there is always a considerable water flow through the suction head, clogging of the suction head is prevented in case of a sudden accumulation of soil at the suction head as may occur, e.g., if the side walls of the pit in which suction is being effected should collapse.

When furthermore, as known per se, use is made of a water pressure pump for the supply of the water supply conduit, there may be provided a selectively operable connection for the supply side of the pump with the overflow of the hopper or e.g. with a water supply outside the hopper.

Some embodiments of the invention will now be explained with reference to the accompanying drawings, wherein FIG. 1 schematically shows in side view a suction dredger of the drag nozzle type;

FIG. 2 schematically shows in side view a stationary floating suction dredger;

FIG. 3 schematically shows on an enlarged scale, in side view, details of a modified conduit system for a suction dredger of the drag nozzle type shown in FIG. 1;

Figure 1:
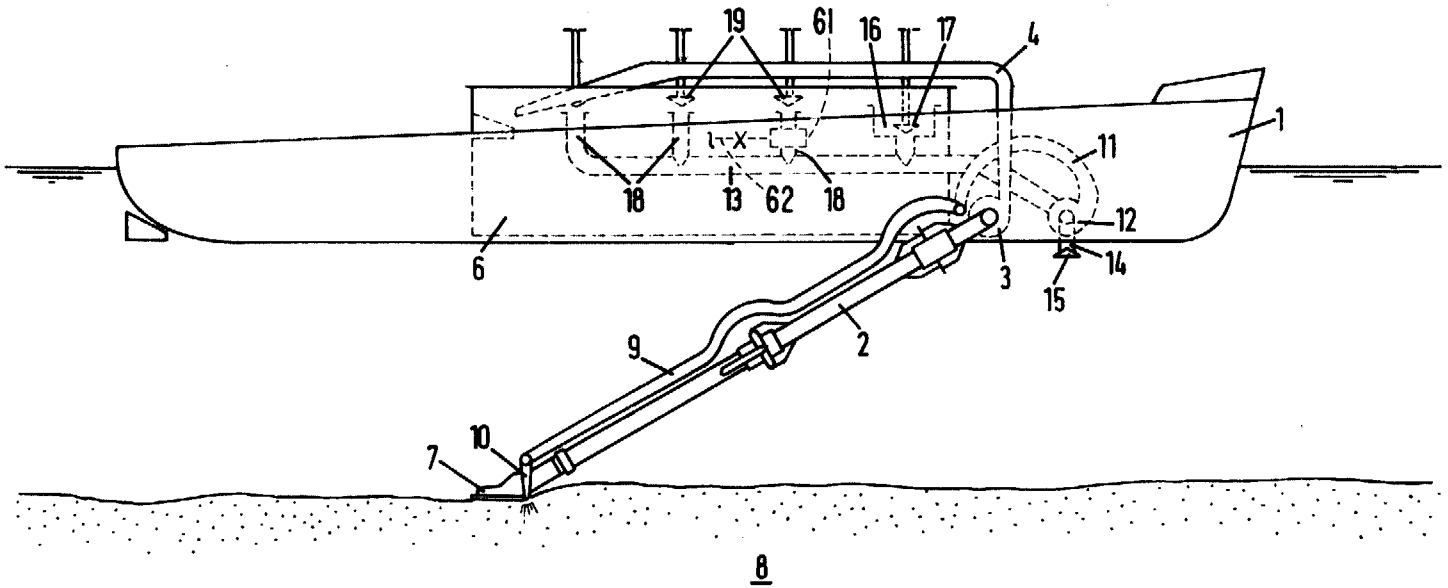

A suction dredger of the drag nozzle type generally indicated by 1 in FIG. 1 is provided with a suction conduit 2, which via a suction pump 3 and a delivery line 4, is connected to a hopper 6 of the above suction dredger.

At its end the suction conduit 2 carries a suction head enclosure or drag nozzle 7 resting on the sea bottom. This device is displaced by the slowly sailing vessel over the soil 8, e.g. the sea bottom.

Parallel to the suction conduit 2 runs a pressure water line 9 with nozzles 10. Via a connection conduit 11 the pressure water conduit is connected to a pressure water pump 12 which at the one end communicates with an overflow 13 and on the other end with the water outside the vessel by means of a conduit 14 which can be closed by means of a valve 15. The overflow 13 at 16 is provided with an overflow reservoir having a shut-off valve 17. At 18 and 19 are indicated a number of other connection pipes with shut-off valves portioned in other places. The reservoir 16 may also be replaced by or supplemented by known per se separators such as a bent strainer, a cyclone or the like apparatus for increasing the concentration of the soil particles in the flushing or recycled water. Thus, a separator 62 of known type can be used to separate removed transport fluid into two streams of resepctively higher and lower soil particle concentration. Depending upon environmental consideration, the lower concentration stream can be discharged over the side as by means of line 62. The higher concentration stream is recycled to pressure line 9.

Figure 2:
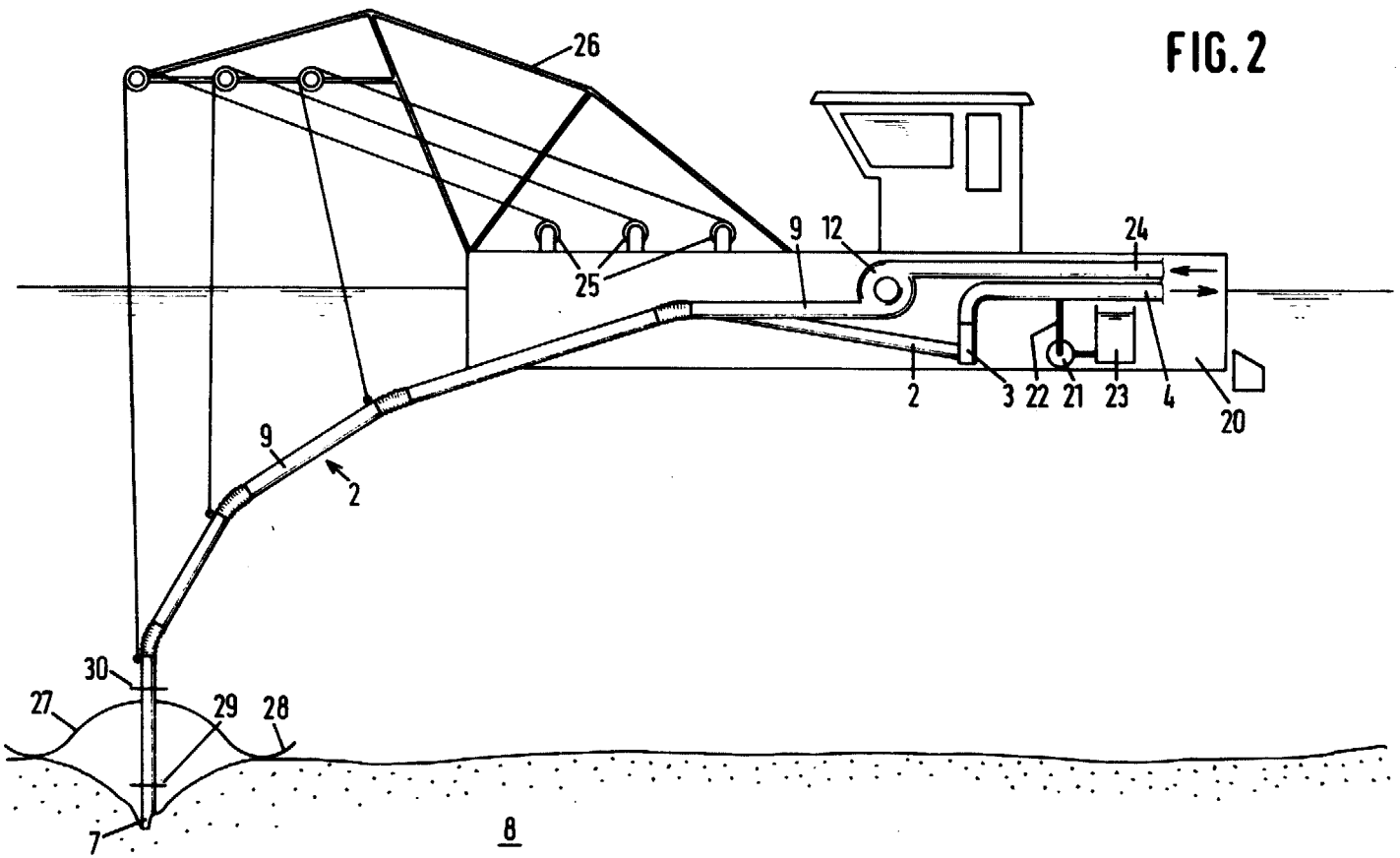

FIG. 2 shows a floating dredger for stationary use. The vessel 20 comprised, e.g., of a plurality of pontoons is again provided with a suction line 2, a double-acting pump 3 and a pressure line 4, which in known manner can be connected to a dump, a separate dredging barge, hopper barge, shore hopper or the like. There is connected to the pressure conduit 4, via pump 21 and an auxiliary conduit 22, a storage tank 23 with settling promoters which are employed for the purposes and in a manner well known by those skilled in the art. A pressure water line 9 is connected to a pressure water pump 12. The supply line thereof is indicated by 24 and is connected likewise in a known per se manner, not shown, to a reservoir for the cycling water, e.g. a dredging barge or an overflow. Furthermore there are mounted on the vessel a plurality of winches 25 which via a lifting arm 26 control the suction line 2 and the pressure water line 9. Adjacent the end of the suction line and the pressure water line there is mounted a cheek 27. In the left portion of FIG. 2 the suction line 2 lies behind the pressure water line 9.

The cheek 27 has a disked configuration and is made of a light metal, or of synthetic material or rubber and may be provided with floating boxes for obtaining an adapted force with which the cheek is pressed to the ground. The edges of the cheek are slightly curved upwardly to facilitate the sand flow. There may be disposed along the edge rubber sealing elements for improving the sealing on an uneven soil. Said cheek rests with its edges 28 on the soil while the suction head 7 has sucked a breach in the soil 8 to be sucked up. Underneath the cheek 27 ends the pressure water line 9. The cheek 27 in the example is movable vertically along the end of the suction line 2 and the pressure water line 9 between stops 29 and 30.

Figure 3:
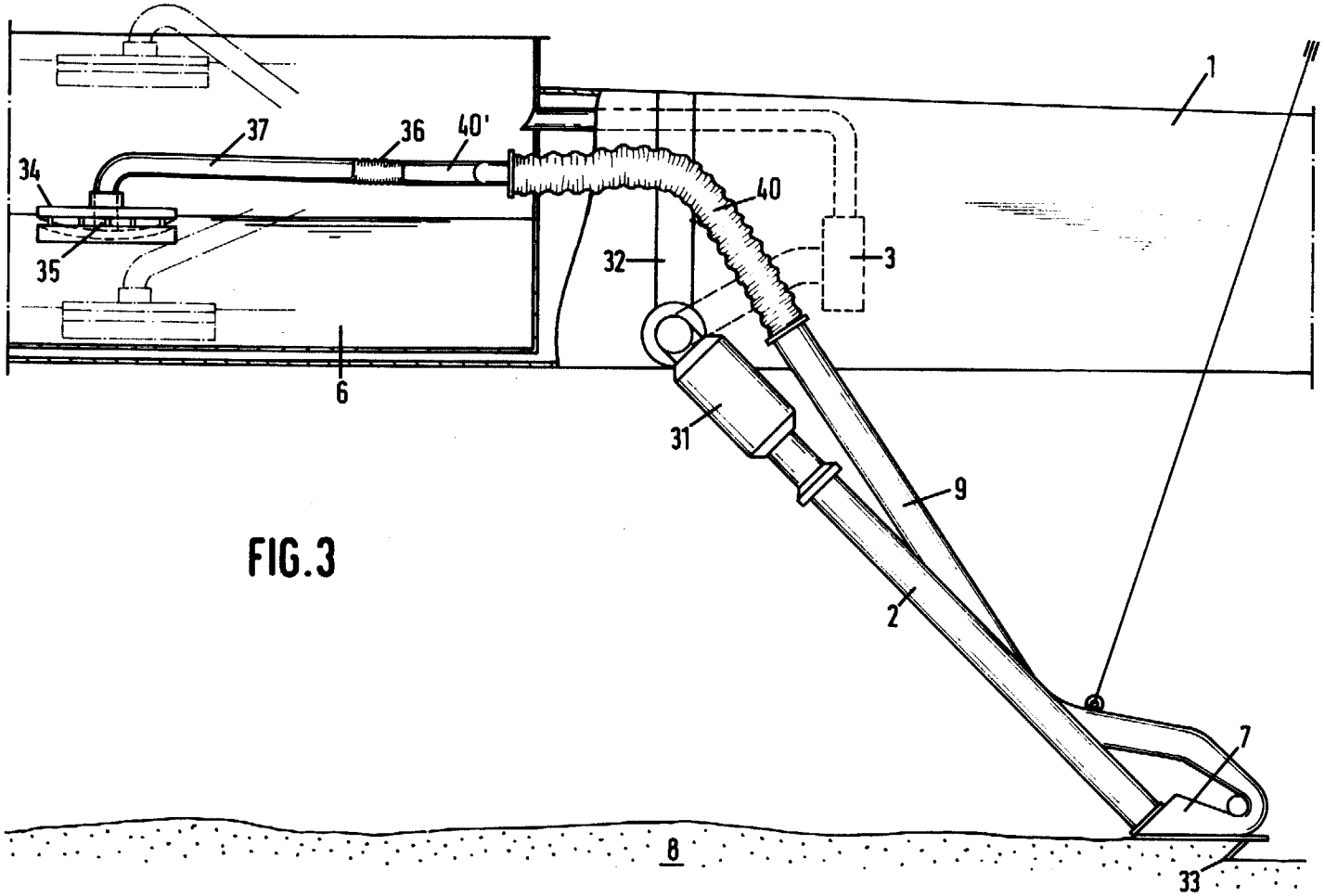
Figure 4:
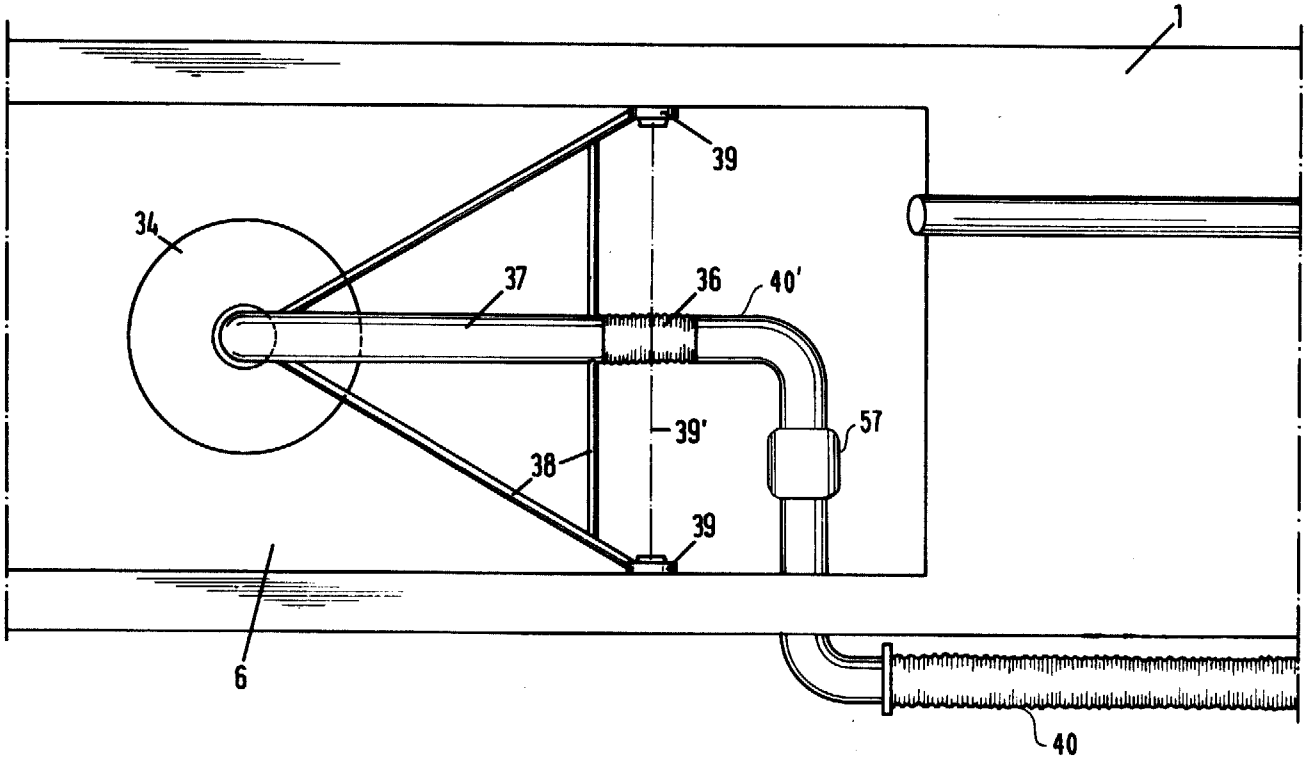
FIG. 4 is a top view of a detail shown in FIG. 3.

FIG. 3 shows details of a different embodiment of the suction dredger of the drag nozzle type according to FIG. 1. The suction line 2 at 31 is provided with a universal joint. The double-acting pump is indicated at 3, while 32 represents a guide aside the ship's hull for emerging the suction line. The suction head 7 is provided with a blade 33 for loosening the soil. The pressure water line is again indicated by 9 and the pressure water pump by 57 (FIG. 4). The water supply to the pressure water line 9 takes place by means of a suction basket 34 floating on the surface of the water in the hopper 6 and which is provided around with a slotted mouth 35 which sucks up the water adjacent the surface and discharges same via line 37 provided with a flexible segment 36. In FIG. 4 there is shown a top view of the suction basket 34, whereby in addition to the flexible segment 36 and the line 37, there is also shown a support construction 38 pivoting at 39 about a swivel axle 39' common with the pivot 36 for supporting the suction basket for vertical movement of same in the hopper 6 and following changes of the level of suspension thereon. The pressure water line 9 is connected by means of a flexible hose 40 to a stationary portion of the line 40', thus enabling a pivotal movement. Naturally use can also be made of a suction basket which is mechanically adjustable in height, e.g. by means of an automatically controlled or non-automatically controlled winch rope.

Figure 5:
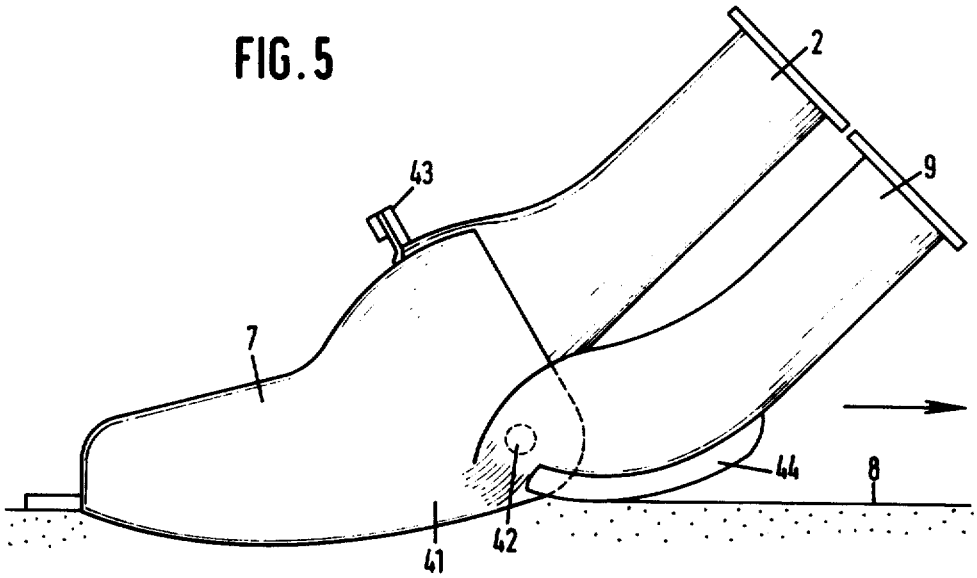
FIG. 5, 6 and 7 show different embodiment of suction heads.
Figure 6:
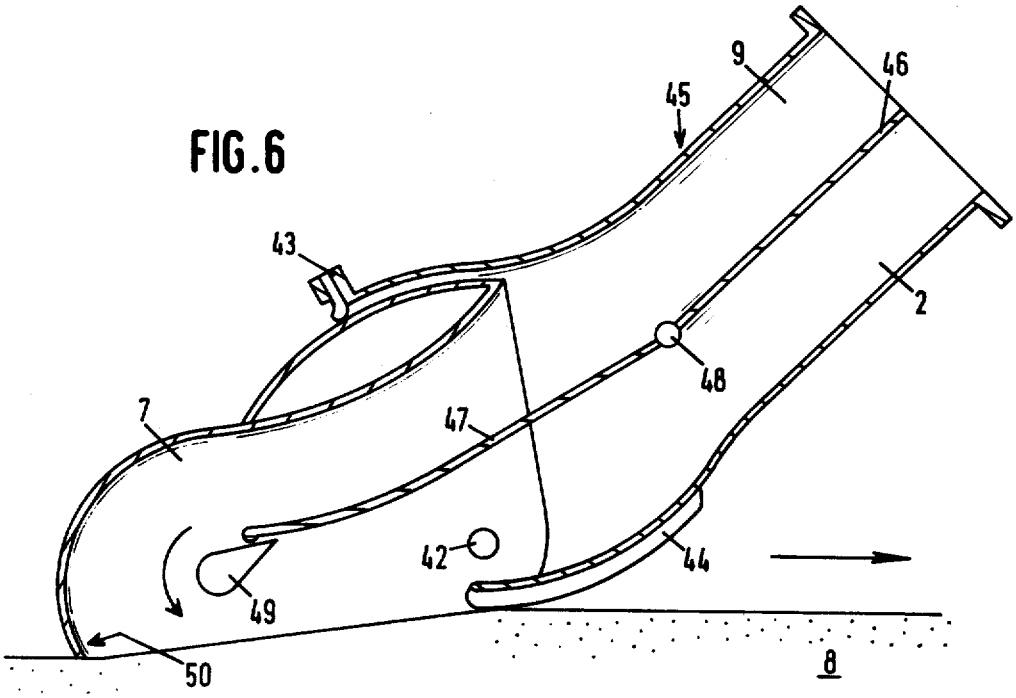
Figure 7:
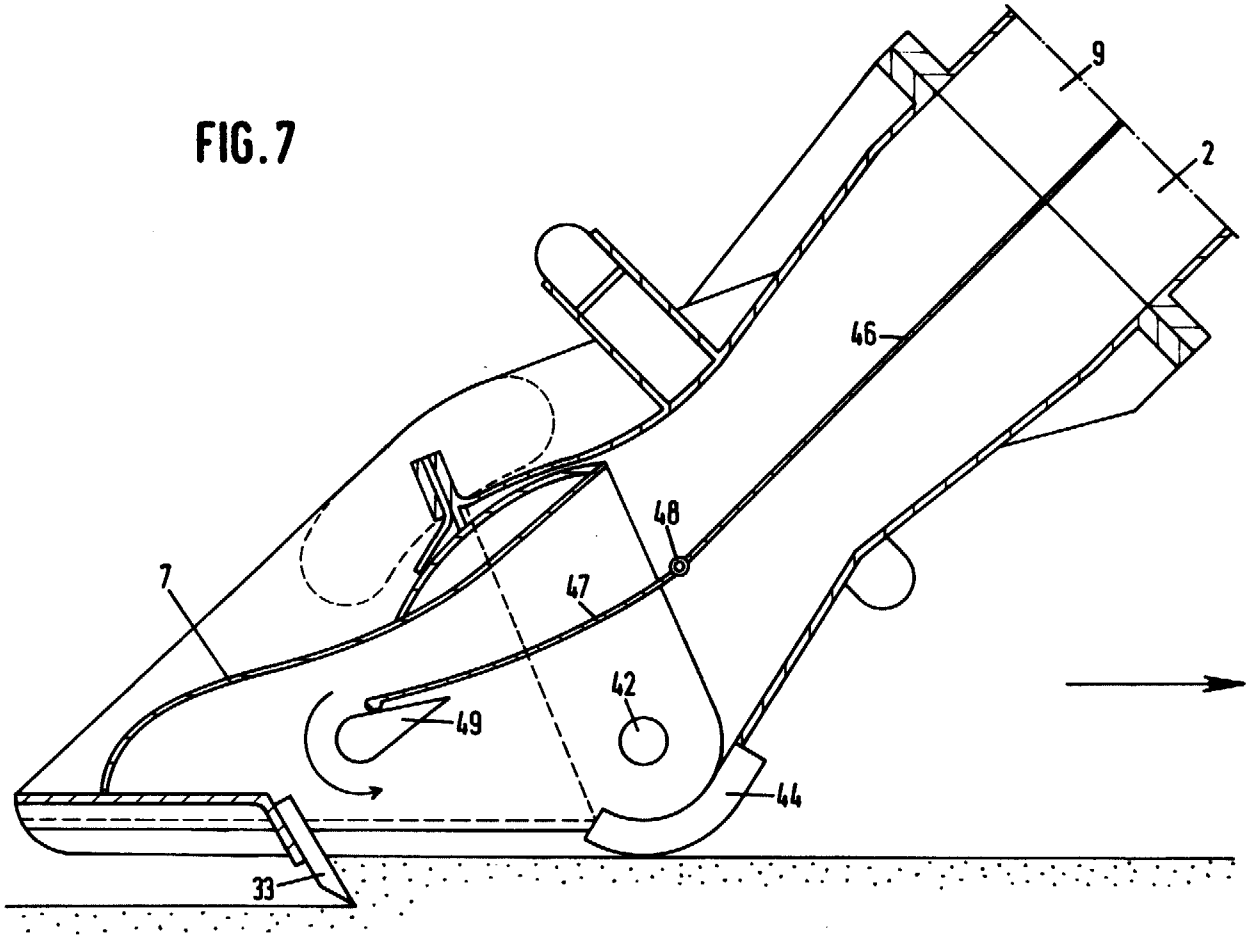

FIGS. 5, 6 and 7 show a drag nozzle 7 with part of the suction tube 2 and of the pressure water line 9. As shown in FIG. 5 use is made of two parallel round pipes 2, respectively 9, having substantially the same diameter. The pressure water, seen in the drag direction, terminates in the front part of suction head 7 at 41. The drag mozzle 7 itself is pivotally connected at 42 to the two lines, while at 43 there is shown a sealing. 44 is a wear-resistant shoe with which the drag nozzle is entrained over the bottom.

As shown at FIG. 6 the starting point is a single suction pipe 45 which is divided by a partition 46 into a pressure water line 9 and a suction line 2. The drag nozzle 7 again is pivotal at 42, while at 43 is shown a sealing which seals a cylindrical portion of a suction head. In the embodiment shown in FIG. 6 the direction of the supplied pressure water is opposite to that shown in FIG. 5. The latter portion 47 of the partition is pivotal at 48 for adaptation to the position of the drag nozzle, while bearing on a support axle 49 in the drag nozzle. The back section of the drag nozzle is provided with an end edge 50. Naturally it is also possible for the pivot 42 to be mounted in a higher position, in which case it can coincide with the pivot 48, so that the partition 47 can be fixedly mounted in the drag nozzle 7.

In the embodiment shown in FIG. 5 a relative displacement with respect to the suction head or drag nozzle will take place in connection with the inertia of the loosened soil, so that those soil particles will be entrained more easily with the water flow from the pressure line 9 into the suction line 2.

FIG. 7 shows a variant of the embodiment shown in FIG. 6 wherein instead of an end edge 50 there is mounted a separate cutter 33.

I claim:

1. A method for removing soil and the like from the sea bottom for delivery of the same to a collection operation on the sea surface through a conduit having a suction head enclosure at one end thereof and resting on the sea bottom, the other end of said conduit communicating with a collection hopper on the surface, said method comprising pumping a transport fluid from a source thereof on the surface under pressure through a second conduit extending from said source to the interior of said suction to said firstmentioned conduit whereby a soil suspension in said transport fluid is caused to be conveyed through said first-mentioned conduit to said collection hopper, removing at least a part of the transport fluid from the suspension delivered to said collection hopper for conveyance to said second conduit as said transport fluid source, and subjecting the transport fluid removed from the suspension prior to conveyance thereof to said second conduit to a separation operation for separating it into two streams with respectively a higher and a lower soil particle concentration, the stream of higher soils particle concentration being conveyed to said second conduit.

2. A method in accordance with claim 1 wherein the sea from which soil is being removed is a salt water body and the transport fluid source on said surface is a source of fresh water.

3. Apparatus for removing soil and the like from the sea bottom for delivery of same to a collection operation on the sea surface comrpising a collection hopper a suction pump having suction and discharge sides a first conduit connected at one end to the suction side of said suction pump and having a suction head enclosure at its other end, said suction head enclosure being adapted for positioning of the same on the sea bottom, a delivery line extending from the discharge side of said suction pump to said collection hopper, a source of transport fluid, a pressure pump having suction and discharge sides there being conduit means connecting the suction side of said pump with said source, a second conduit connected at one end with the discharge side of said pressure pump, the other end of said second conduit extending to and being connected with said suction head enclosure in communication with the interior of said suction head enclosure, operation of said suction pump and said pressure pump being effective to cause a soil suspension in said transport fluid to be conveyed to said collection hopper, and means for removing at least a part of the transport fluid from the suspension delivered to said collection hopper for conveyance of said removed part to said conduit means as said source, said removal means comprising an overflow on said hopper communicating with said conduit means, said apparatus further including separating means intervening said overflow and the suction side of said pressure pump for separating said removed part of the transport fluid into two streams with respectively a higher and a lower soil particle concentration, there being means associated therewith for selectively conveying the lower soil particle concentration stream to discharge in the sea.

4. Apparatus in accordance with claim 3 in which said overflow comprises a suction basket floating on the soil suspension present in said hopper and connected with said conduit means, there being means for supporting said suction basket for vertical movement in said hopper responsive to changes in the level of soil suspension in said hopper.

* * * * *